US005361429A

United States Patent [19]

Lin

[11] Patent Number: 5,361,429

[45] Date of Patent: Nov. 8, 1994

[54] DOUBLE TUB BATH STRUCTURE

[76] Inventor: Jung-Fa Lin, 7 Lane Chung, Cheng Kwei, Lin Li Chu Shan Jenn, Nantou,

[21] Appl. No.: 148,322

[22] Filed: Nov. 8, 1993

[51] Int. Cl.[5] ..... A47K 3/024

[52] U.S. Cl. ..... 4/572.1; 4/546; 4/554; 4/641

[58] Field of Search ..... 4/538, 539, 546, 548, 4/551, 559, 564.1, 565.1, 566.1, 571.1, 572.1, 573.1, 578.1, 579, 584, 641, 642, 553, 554, 643

[56] References Cited

U.S. PATENT DOCUMENTS

| | | | |
|---|---|---|---|
| 2,765,475 | 10/1956 | Nolan | 4/554 X |
| 2,812,518 | 11/1957 | O'Brien et al. | 4/539 X |
| 3,969,776 | 7/1976 | Gildea | 4/546 |
| 4,881,281 | 11/1989 | Lavoine et al. | 4/572.1 |
| 5,033,131 | 7/1991 | Paden | 4/572.1 |

FOREIGN PATENT DOCUMENTS

| | | | |
|---|---|---|---|
| 1064562 | 10/1952 | France | 4/546 |

*Primary Examiner*—Charles E. Phillips

*Attorney, Agent, or Firm*—Morton J. Rosenberg; David I. Klein

[57] ABSTRACT

A double tub bath structure includes a primary tub defining therein a water containing recess, a secondary tub smaller than the primary tub and movably disposed within the primary tub by being supported by a support plate and a hood serving as a canopy to cover the water containing recess removably secured to the primary tub. A positioning rod with a plurality of positioning holes formed thereon is secured to the support plate and is movably received within a slot formed in the primary tub. A control lever pivoted within a deep hole juxtaposing the slot is allowed to rotate relative to the positioning rod to have a retaining end thereof engage one of the positioning holes to hold the support plate at a desired position within the primary tub. Wheels may be provided on the primary tub to help moving the double tub bath. The canopy may include a net member to provide air ventilation so that the double tub bath may serve as a baby perambulator with the baby sitting or lying down in the secondary tub.

11 Claims, 3 Drawing Sheets

DOUBLE TUB BATH STRUCTURE

FIELD OF THE INVENTION

The invention is directed generally to a bath and in particular to a double tub baby bath structure.

BACKGROUND OF THE INVENTION

Conventional baby bathes have a simple container-like structure or an air-inflatable structure which may also serve as a small swimming pool. An disadvantage of the baby bath of these types is that the water level within the bath is hard to adjust relative to the size of the baby to be bathed therein. Further, in case that changing water when the baby is being bathed has to be done, it is also very difficult to do so. Moreover, the baby to be bathed in these conventional baby bathes has to be held by the hands of its parent or baby sitter and it may some times happen that the baby accidently falls onto ground or into the baby bath and thus hurt.

In addition, such conventional baby bathes have such a structure which has substantially no maneuverability so that moving the baby bathes to everywhere is quite inconvenient.

It is therefore desirable to provide a double tub bath structure which has a location-adjustable baby holder inside a water container and wheels mounted thereon so as to overcome the above-mentioned problems.

SUMMARY OF THE INVENTION

The principal objective of the present invention is to provide a double tub bath structure which comprises a secondary tub, serving as a baby holder, location-adjustably or movably disposed inside a primary tub, serving as a water container, so that by adjusting the location of the secondary tub relative to the primary tub, the baby sitting or lying down in the secondary tub can be suitably and adjustably dipped into the water contained in the primary tub.

It is another objective of the present invention to provide a double tub bath which comprises wheels mounted on the primary tub thereof to allow a user to move the bath easily.

It is a further objective of the present invention to provide a double tub bath which comprises an optional air-ventilated hood releasably mounted on the primary tub so that the primary tub which has the wheels mounted thereon is capable to serve as a perambulator with the hood serving as a canopy thereof.

To achieve the above-mentioned objectives, there is provided a double tub bath structure comprising a primary tub defining therein a water containing recess, a secondary tub smaller than the primary tub and movably disposed within the primary tub by being supported by a support plate and a hood serving as a canopy to cover the water containing recess removably secured to the primary tub. A positioning rod with a plurality of positioning holes formed thereon is secured to the support plate and is movably received within a slot formed in the primary tub. A control lever pivoted within a deep hole juxtaposing the slot is allowed to rotate relative to the positioning rod to have a retaining end thereof engage one of the positioning holes to hold the support plate at a desired position within the primary tub. Wheels may be provided on the primary tub to help moving the double tub bath. The canopy may comprise a net member to provide air ventilation so that the double tub bath may serve as a baby perambulator with the baby sitting or lying down in the secondary tub.

BRIEF DESCRIPTION OF THE DRAWINGS

Other objectives and advantages of the invention will be apparent from the following description of a preferred embodiment of the present invention taken in connection with the accompanying drawings wherein.

DETAILED DESCRIPTION OF THE PREFERRED EMBODIMENT

Figure 1:
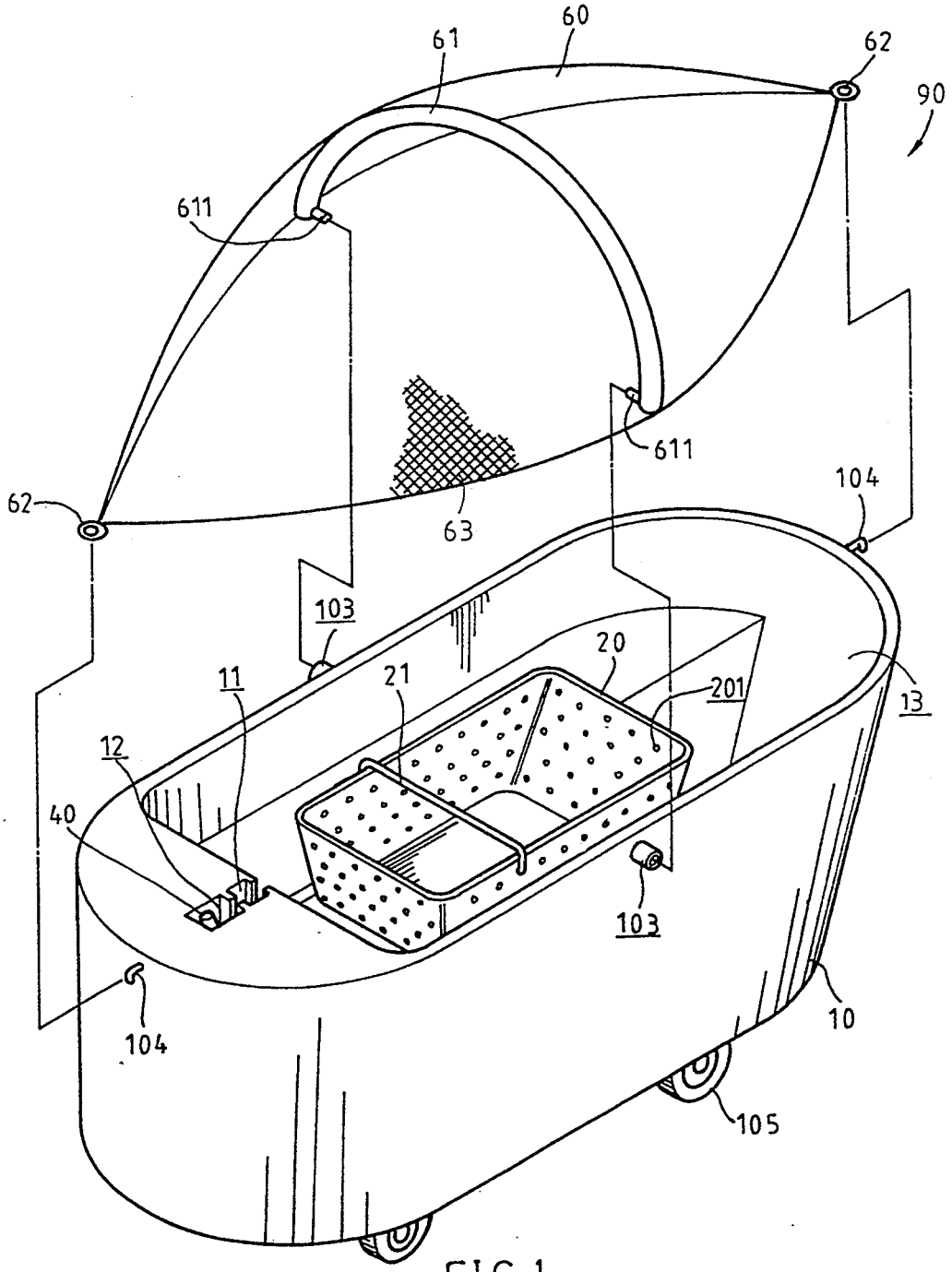
FIG. 1 is a perspective view showing a double tub bath constructed in accordance with the present invention, with a hood thereof shown detached therefrom.

With reference to the drawings and in particular to FIG. 1, wherein a double tub bath constructed in accordance with the present invention, generally designated with the reference numeral 90, is shown, the double tub bath 90 comprises a primary tub 10 defining therein a water containing recess 13 for receiving therein water (not shown), a secondary tub 20 which is smaller than the primary tub 10 and location-adjustably or movably disposed therein, an optional hood 60 which is removably attached to and covering the primary tub 10.

Preferably, the primary tub 10 has a size suitable for children aged 2–5 to be bathed therein and the size of the secondary tub 20 is good for babies or children below two.

Figure 2:
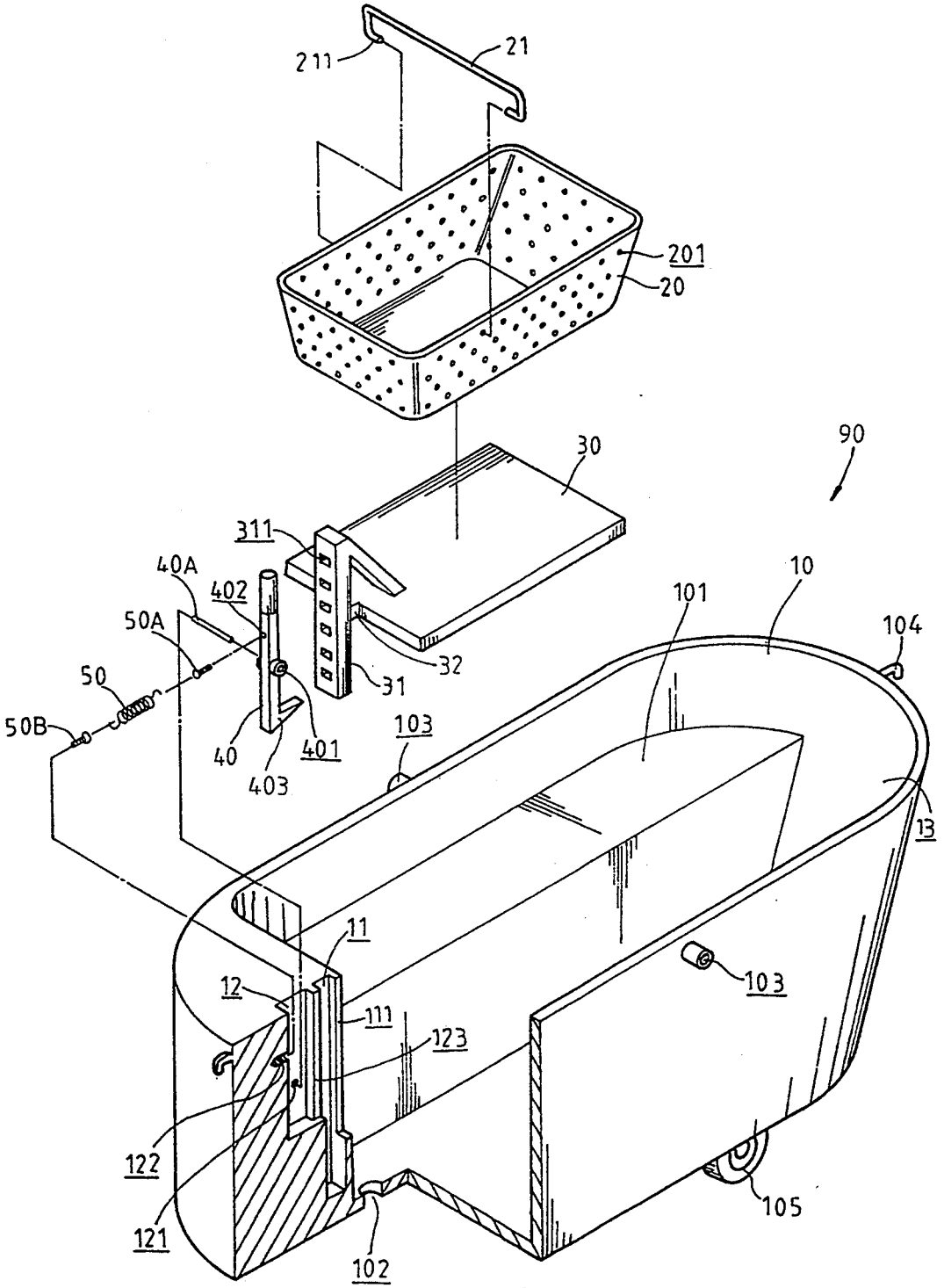
FIG. 2 is an exploded view showing the double tub bath of the present invention with a portion cut away to show the inside detail and the hood removed.
Figure 3:
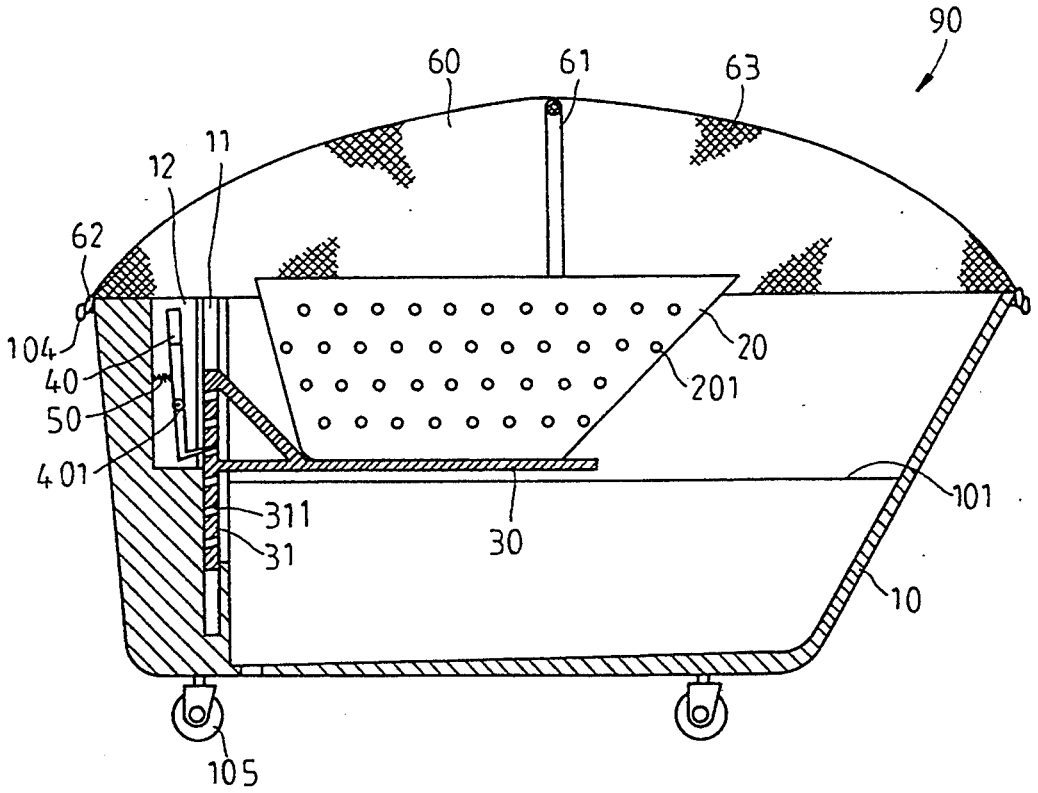
FIG. 3 is a cross-sectional view showing the double tub bath of the present invention.

Further referring to FIGS. 2 and 3, in the water containing recess 13 of the primary tub 10, a step 101 is formed which serves as a seat for children aged 2–5 to sit thereon when bathed. As is generally known, the primary tub 10 is provided with drains, such as a hole 102, for draining used water.

At a suitable location of the primary tub 10, a slot 11 is formed with an upper end thereof opened to movably receive therein an elongated positioning rod 31 which is secured to a support plate 30 in a substantially normal manner. The support plate 30 is for supporting thereon the secondary tub 20.

An elongated slit 111 is formed between the slot 11 and the water containing recess 13 of the primary tub 10 to movably receive therein a reduced connection neck 32 between the support plate 30 and the positioning rod 31 so as to allow the support plate 30 which is disposed within the water containing recess 13 of the primary tub 10 and the positioning rod 31 which is received within the slot 11 separated from the water containing recess 13 to move together.

The slot 11 is longer than the positioning rod 31 so that the positioning rod 31 is allowed to move up and down within the slot 11 and thus moving the support plate 30 together with the secondary tub 20 placed thereon up and down within the water containing recess 13 of the primary tub 10. The position of the support plate 30 within the water containing recess 13 is controlled by control means to be described hereinafter.

The positioning rod 31 has a plurality of positioning holes 311 formed thereon and along the length thereof, preferably in an equally-spaced manner. Each of the holes 311 corresponds to a pre-determined position of the support plate 30 relative to the primary tub 10.

As mentioned previously, the secondary tub 20 has such a size suitable for placing a young baby therein. Preferably, the secondary tub 20 comprises a body similar to a conventional baby bath or a carrycot inside which the baby is placed. The secondary tub 20 comprises a plurality of apertures 201 formed on the body thereof to allow water to flow in and out so that by moving the support plate 30 deep into the water contained in the water containing recess 13, the water is allowed to flow into the secondary tub 20 and bathing the baby may be carried out without any potential risk of drowning the baby in the deep water containing recess 13 by falling the baby into the water containing recess 13.

A protective bar 21 formed in the shape of a U with two bent ends 211 pointing toward each other to be respectively receivable within one of the apertures 201 for holding the baby inside the second tub 20 is releasably secured to the secondary tub 20. The bar 21 may be made of a resilient material so that it can be moved from or secured to the secondary tub 20 by elastically deforming the U shape to move the bent ends 211 thereof relative to the secondary tub 20.

The control means for controlling the positioning of the support plate 30 comprises a deep hole 12 formed in the primary tub 10, juxtaposing the slot 11, with a slit 123 therebetween to allow a retaining end 403 of a control lever 40 to extend therethrough to engage one of the holes 311 formed on the rod 31 so as to determine the position of the support plate 30 and thus the secondary tub 20 relative to the primary tub 10.

The control lever 40 is disposed within the deep hole 12 and is rotatably supported by a pivot 40A which extends through a hole 401 formed on the control lever 40 and has two ends respectively received within a pivot hole 121 formed on the side wall of the deep hole 12 so as to allow the control lever 40 to be swingable within the deep hole 12. Accordingly, by rotating the control lever 40 relative to the pivot 40A, the retaining end 403 which is an extension substantially normal to the control lever 40 is moved relative to the positioning rod 31 to engage/disengage with one of the holes 311 of the positioning rod 31 and thus positioning the support plate 30 at a selected position, associated with the one of the holes 311 engaged by the retaining end 403, relative to the primary tub 10 or to release the support plate 30 from such a position.

As shown in FIG. 3, the holes 311 formed on the positioning rod 31 are preferably slightly inclined relative to the length of the positioning rod 31 to prevent the engagement thereof with the retaining end 403 from being broken accidently.

Preferably, biasing means, such as a helical spring 50, is provided to bias the control lever 40 toward the position engaging the hole 311 of the position rod 31. This prevents the engagement between the retaining end 403 of the control lever 40 and the hole 311 of the positioning rod 31 from being accidently broken and thus tragically allowing the baby staying or lying down in the secondary tub 20 which is supported by the support plate 20 to unexpectedly move down into depth of the water containing recess 13.

Preferably, the helical spring 50 has an end secured to the control lever 40 by a first screw 50A secured on a first screw hole 402 formed on the control lever 40 and an opposite end secured to the side wall of the deep hole 12 by a second screw 50B secured in a second screw hole 122 formed on the side wall of the deep hole 12.

Preferably, the primary tub 10 is provided with wheels 105 for movement thereof to any desired locations.

The hood 60 comprises a frame having a main rib member 61 in the form of a semi-circle with a net member 63 secured thereon. The semi-circular rib member 61 has two inward-projected bosses 611 which are respectively removably received within a hole 103 formed on the primary tub 10 to removably attach the hood 60 to the primary tub 10. The hood frame may also comprise two ring members 62 to respectively receive therein a hook member 104 secured on the primary tub 10 to hold the hood 60 in position relative to the primary tub 10 to completely cover the water containing recess 13 of the primary tub 10 while still allowing air ventilation. This hood 60 provides means for preventing insects or beetles which may hurt the baby from getting into the primary tub 10.

In use of the double tub bath 90 of the present invention, a user may fill the water containing recess 13 of the primary tub 10 with water and place a child aged 2–5 therein for bath, or alternatively, the user may place a younger child or baby in the secondary tub 20 and using the control lever 40 to position the secondary tub 20 in a desired location inside the primary tub 10.

In addition, the present invention provides a further way to use, in which the primary tub 10 with the wheels 105 mounted thereunder and the hood 60 secured thereon serves as a baby perambulator when no water is existing therein. The secondary tub 20 provides means for adjusting the baby's location within the baby perambulator constituted by the primary tub 10.

It is apparent that although the invention has been described in connection with the preferred embodiment, those skilled in the art may make changes to certain features of the preferred embodiment without departing from the spirit and scope of the invention as defined in the appended claims.

What is claimed is:

1. A double tub bath structure comprising:

primary tub forming therein a water containing recess having a first volumetric dimension;

a secondary tub insertable within and adjustably positionable within said primary tub, said secondary tub having an exterior volumetric dimension less than said first volumetric dimension, said secondary tub having a plurality of through apertures to allow water to flow therethrough;

movable support means for adjustably positioning and supporting said secondary tub within said primary tub to allow said secondary tub to be locationally mounted at different portions within said primary tub, said movable support means including a support plate upon which said secondary tub is removably mounted, said support plate being releasably secured to said primary tub;

control means for releasably holding said movable support means at a desired position within said primary tub so that by releasing said control means, said movable support means is freed to move relative to said primary tub to change the position of said secondary tub.

2. A double tub bath structure as claimed in claim 1 wherein said movable support means includes an elongated rod slidably received within an elongated slot formed in said primary tub, said elongated rod being displaceable with respect to said primary tub, said elongated rod being secured to said support plate in a substantially normal manner having a reduced neck connected therebetween, said neck being movably received through a slit formed in a slot wall between said water containing recess and said slot to allow said support plate to be moved within said water containing recess by the movement of said elongated rod within said slot.

3. A double tub bath structure as claimed in claim 2 wherein said control means comprises a plurality of holes formed along the length of said elongated rod and a control lever pivoted to said primary tub having a bent end releasably engageable with selective ones of said holes of said elongated rod to hold said elongated rod at said desired position corresponding to a selective one of said holes being engaged by the bent end of said control lever.

4. A double tub bath structure as claimed in claim 3 wherein said control means comprises biasing means to bias said bent end to selectively engage one of the holes of said elongated rod.

5. A double tub bath structure as claimed in claim 4 wherein said biasing means comprises a helical spring having a first end secured to said primary tub and a second end secured to said control lever.

6. A double tub bath structure as claimed in claim 1 wherein said primary tub has wheels mounted thereon to rollingly support said double tub bath structure on an external structure.

7. A double tub bath structure as claimed in claim 1 wherein said secondary tub has a protective bar releasably mounted thereto, said protective bar comprising a U shape having two bent ends pointing toward each other to be respectively received within one of the apertures formed through said secondary tub to hold a baby inside said second tub.

8. A double tub bath structure as claimed in claim 1 further comprising a removable hood covering said primary tub.

9. A double tub bath structure as claimed in claim 8 wherein said hood comprises an air ventilated canopy secured to a frame to provide air ventilation, said frame including a main rib in the form of a semi-circle having opposing ends releasably received within two respective holes formed in said primary tub to removably secure said hood to said primary tub.

10. A double tub bath structure as claimed in claim 9 wherein said hood frame further comprises two ring members mounted thereto to respectively engage a hook member formed on said primary tub for securing said hood on said primary tub.

11. A double tub bath structure as claimed in claim 9 wherein said air ventilated canopy comprises a net member.

* * * * *